United States Patent [19]

Wolters

[11] 4,014,200

[45] Mar. 29, 1977

[54] CLEAT EDGE FORMING MACHINE

[76] Inventor: Oswald H. Wolters, Rte. 3, Sparta, Ill. 62286

[22] Filed: Oct. 24, 1975

[21] Appl. No.: 625,543

[52] U.S. Cl. ..... 72/315; 72/DIG. 21

[51] Int. Cl.[2] ..... B21D 25/02

[58] Field of Search ..... 72/312, 313, 315, 320, 72/388, DIG. 21

[56] References Cited

UNITED STATES PATENTS

| | | | |
|---|---|---|---|
| 2,722,858 | 11/1955 | Oyen | 72/312 X |
| 2,973,796 | 3/1961 | Engel et al. | 72/315 |
| 3,350,912 | 11/1967 | Smith, Jr. | 72/319 |

*Primary Examiner*—Gil Weidenfeld

*Attorney, Agent, or Firm*—Gravely, Lieder & Woodruff

[57] ABSTRACT

A machine for forming a reversely bent cleat edge on sheet metal includes a frame having a horizontal plate-like anvil provided with a free edge, and the anvil supports the sheet metal with a portion of it projected beyond the free edge. A deforming beam is moved by an eccentric shaft, and when so moved the forward end of the beam passes downwardly and engages the portion of the sheet metal projecting beyond the edge so as to bend that portion downwardly. Further rotation of the eccentric shaft causes the beam to move forwardly underneath the anvil and thereby turns the bent portion of sheet metal beneath the anvil so as to create the reversely bent cleat edge. As the beam bends the sheet metal, a hold down mechanism clamps the sheet metal against the anvil, and the hold down mechanism is held in its clamping position by cams which turn with the eccentric shaft. A gauging mechanism is located beneath the beam to position the sheet metal on the anvil with the proper amount thereof projected beyond the free edge. The gauging mechanism does not obstruct disengagement of the duct from the machine, and in fact assists in disengaging the cleat edge from the anvil once the cleat edge is formed.

24 Claims, 10 Drawing Figures

FIG. 1
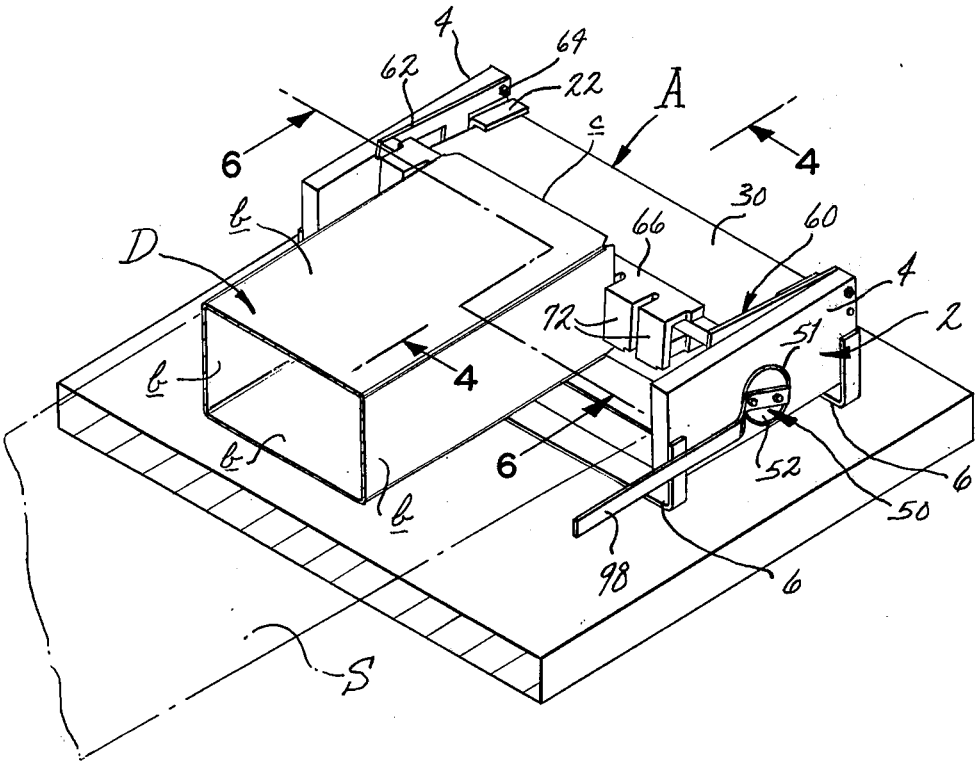
FIG. 2
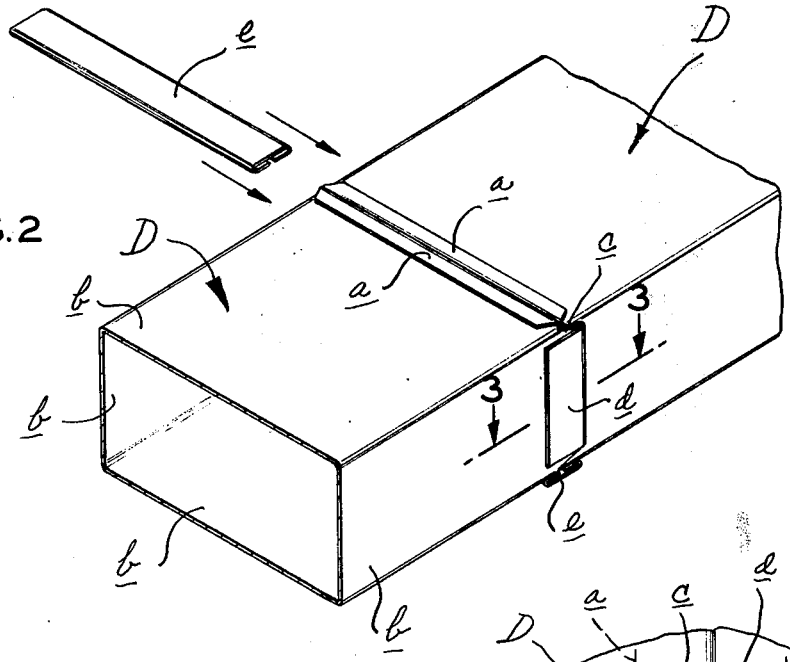
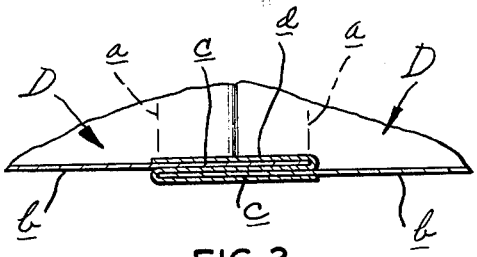
FIG. 3

CLEAT EDGE FORMING MACHINE

BACKGROUND OF THE INVENTION

This invention relates in general to machines for working sheet metal, and more particularly to a machine for bending reverse flanges or cleat edges on sheet metal.

The duct work in most residential, commercial and industrial buildings is formed from sheet metal with each duct consisting of individual duct sections coupled together at their ends. To join the sections together, corresponding end walls on adjacent duct sections are provided with reverse flanges, called cleat edges, and an interlocking drive cleat is passed over the cleat edges to prevent them and the duct sections of which they form a part from pulling away from each other.

While cleat edges may be formed on ducts by a hand operation, it is difficult to form evenly and correctly gauged cleat edges in such a manner. Moreover, hand forming is quite time consuming. To simplify the cleat edge forming operation, machines have been developed for this purpose. One such machine is disclosed in U.S. Pat. No. 2,973,796. That machine utilizes two bars which engage the end of a duct wall in sequence. The first bars turns the duct wall 90°, while the second bar thereafter turns it another 90° so that as to impart a 180° turn to the wall at its end. However, before first bar is engaged with the wall, a gauge must be positioned beyond the end of the duct and the end wall brought against that gauge. This positions the duct so that the bars will engage the proper amount of metal, thus insuring that the cleat edge which is formed possesses the proper width. Gauging in this manner introduces an additional step into the procedure, and if this step is not performed or is performed incorrectly the machine may jam. Furthermore, once the duct is formed by the machine, the duct is more or less interlocked with the machine and is quite difficult to remove. Aside from the foregoing, the rotating bars must be quite thin so as not to interfere with each other, and as a result, they are not very rigid in extended lengths. As a practical matter, the bars cannot be made much longer than about 24 inches, so these machines cannot be used with ducts greater than 24 inches in width.

SUMMARY OF THE INVENTION

One of the principal objects of the present invention is to provide a machine which forms a reverse flange or cleat edge on the end of a sheet metal. An additional object is to provide a machine of the type stated which may accommodate relatively wide duct sections on the order of at least 36 inches. Another object is to provide a machine of the type stated having a gauge which properly positions the sheet metal prior to forming the cleat edge thereon without having to be positioned itself as a prior step in the cleat edge forming operation. A further object is to provide a machine of the type stated which forms the cleat edge with a single metal deforming element. An additional object is to provide a machine of the type stated which after the cleat edge is formed automatically ejects the sheet metal to a position at which it may be easily removed from the machine. Still another object is to provide a machine which is easy to operate and almost impossible to jam through inadvertance. Yet another object is to provide a machine of the type stated which is simple in construction and highly reliable. These and other objects and advantages will become apparent hereinafter.

The present invention is embodied in a machine including a frame, an anvil on the frame and having a free edge, a deforming beam which is movable from an initial position wherein it does not interfere with sheet metal projected beyond the free edge on the anvil, to a final position, wherein the forward end of the beam is located adjacent to the opposite surface of the anvil, and actuating means for moving the beam from its initial to its final position such that its forward end passes by the free edge, and then along the opposite surface of the anvil to bend the metal reversely into a cleat edge. The invention is further embodied in gauging means which moves the duct slightly backwardly as deforming means approaches it. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a perspective view of the cleat edge forming machine with a duct section positioned upon it;

FIG. 2 is a perspective view showing a typical connection between two duct sections;

FIG. 3 is a sectional view taken along line 3—3 of FIG. 2 and showing the S-strip between two duct sections;

DETAILED DESCRIPTION

Figure 4:
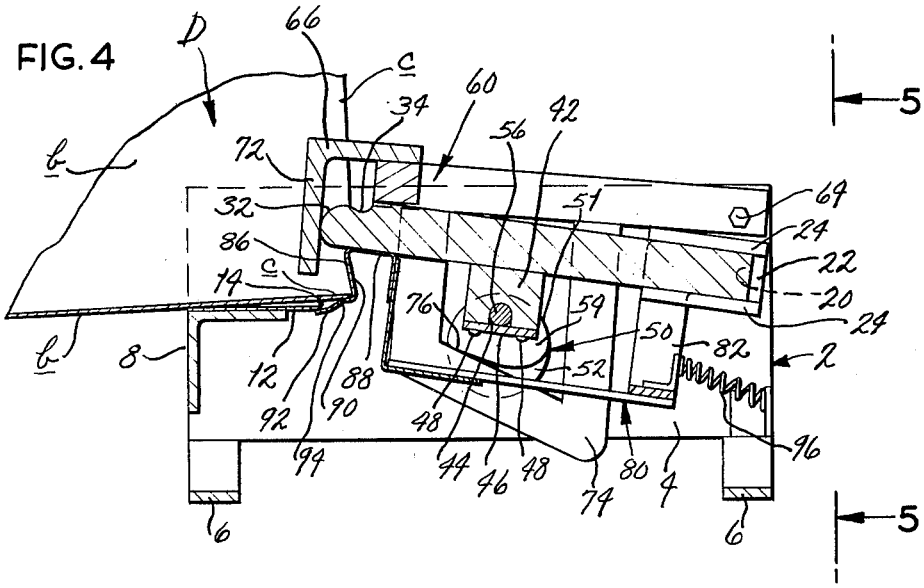
FIG. 4 is a sectional view along line 4—4 of FIG. 1 and showing the deforming beam in its initial position.

Referring now to the drawings (FIG. 1), A designates a cleat edge forming machine which accepts a duct section D to form reverse flanges or cleat edges *a* (FIG. 2) at two of the four walls *b* thereof, and in so doing the machine A turns the sheet metal of the walls *b* a full 180° at the end of the section D. In this regard, the conventional procedure for joining two ducts sections D at their ends is to cut V-shaped notches into the walls *b* at their corners so that each wall *b* is provided with a longitudinal end segment or lip *c*. The lips *c* of the two of the walls *b* are bent rearwardly 180° to form the cleat edges *a*, and the cleat edges *a* of the two duct sections D are brought into abutment, in which case the lips *c* on the remaining two walls *b* will overlap. These overlapping lips *c* are connected together with S-strips *d* which are, as their name implies, S-shaped in cross-section (FIG. 3). The lip *c* of the one wall *b* is received in the one opening of the S configuration, while the lip *c* of the other wall *b* is received in the other opening of the S-configuration. When the S-strips are in place, a drive cleat *e* (FIG. 2) having inwardly turned 180° flanges is engaged at its end with two adjacent cleat edges *a* and is advanced longitudinally along the cleat edges *a* until the two cleat edges *a* are captured within the drive cleat *e* for their entire lengths. Thus, the drive cleat *e* prevents the two duct sections D from pulling apart while, the S-strip *d* and the bent edges of the cleats *a* prevent the duct sections D from moving together.

Figure 6:
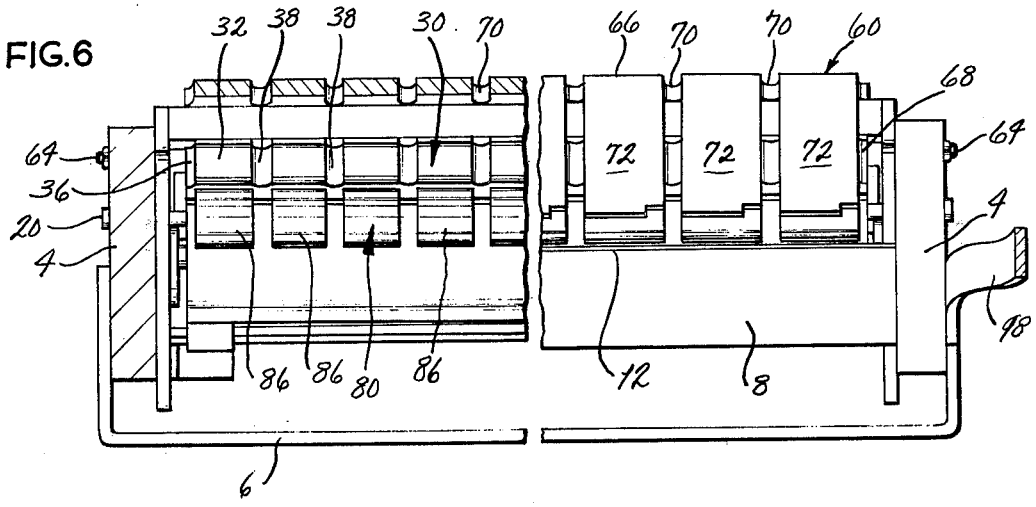
FIG. 6 is a sectional view taken along line 6—6 of FIG. 1 and showing the front of the clamping bar and deforming beam.

The cleat edge forming machine A includes (FIG. 1) a rigid main frame 2 formed from a pair of sidewalls 4 which are connected together at their ends by U-shaped cross members 6 such that the spacing between the sidewalls is slightly greater than the width of the largest duct which the user contemplates producing which may be 36 inches. The cross members 6 serve as legs on which the entire machine A rests. At the front end of the frame 2, the two walls 4 are further spanned by a rigidifying member 8 (FIGS. 4 and 6) which may be a heavy angle. Secured to the rigidifying member 8 is a plate-like anvil 12, which projects rearwardly beyond the rigidifying member 8 and terminates at a free edge 14 (FIG. 4) about which the sheet metal lip *c* of one of the duct walls *b* may be bent. The anvil 12 forms a flush continuation of a work supporting surface (FIG. 1) which is long enough to support the duct section D.

Figure 5:
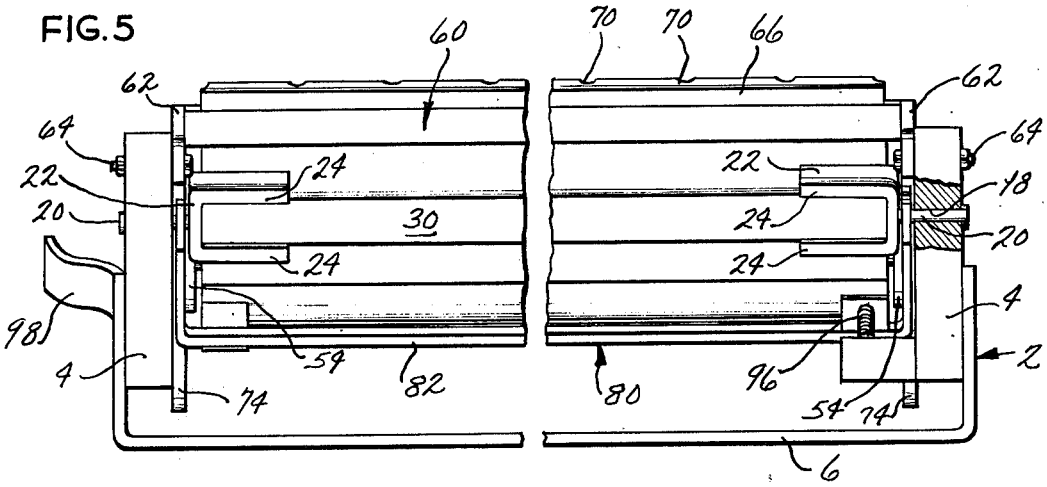
FIG. 5 is a rear elevational view of the cleat edge forming machine.

At the rear end of the frame 2, the two sidewalls 4 are provided with aligned bores 18 (FIG. 5) which serve as bearings for spindles 20 projected from channel-shaped ways 22. The bores 18 are located about one inch higher than the anvil 12 and 8½ inches to the rear of its free edge 14. The ways 22 are attached firmly to their spindles 20, and each has an upper and lower guide flange 24 (FIG. 5) which are parallel. The guide flanges 24 of the two ways 22 project inwardly so that the channels formed thereby in the ways 22 are located opposite each other across the interior of the frame 2.

The ways 22 receive and support the rear end of a deforming beam 30 (FIG. 4) which extends forwardly from the ways 22 to the anvil where its forward end is located. While the ways 22 confine the beam 30 generally in the vertical direction, they do not impede it from moving in the horizontal direction. Furthermore, since the spindles 20 rotate in the bores 18 of the walls 4, the ways 22 will permit the beam 30 to pivot relative to the frame 2.

At its forward end the shaping beam 30 is contoured to provide a convex leading surface 32 (FIG. 4) and a concave upper surface 34. The convex leading surface 32 commences at the flat underside of the beam 30 and extends upwardly therefrom for about 150° so that the convex surface 32 is presented downwardly, forwardly, and also upwardly. The concave surface 34 at its forward end merges into the convex surface 32 and is quite short in comparison to the convex surface 32. The concave surface 34 is presented upwardly and is located below the flat upper surface of the beam 30. The forward end of the beam 30 is further provided with side recesses 36 (FIG. 6) which open forwardly as well as laterally toward the walls 4. The recesses 36 are about ¼ inch deep measured from the sides of the beam 30. Between the side recesses 36, the forward end of the beam 30 has parallel slots 38 which also open forwardly out of the curved surfaces 32 and 34. The slots 38 are about ¼ wide and all but four on the left hand side of the beam 30 are spaced apart on 2 centers. The four slots 38 on the left hand side are spaced on 1½ inch centers. The center to center spacing of the endmost slot 38 and the adjacent recess 36 on the left side of the beam 30 is 1½ inches, while the spacing between the endmost slot 38 and the adjacent recess 36 on the right side of the beam 30 is 2 inches. On its upper surface the beam 30 may be rigidified with a reinforcing member (not shown) which is spaced slightly rearwardly from the concave surface 34.

Welded to the underside of the beam 30 close to midway between its ends is a bearing block 42 (FIG. 4) which extends the entire width of the beam 30 and is provided with a downwardly opening journal cavity 44. The width of the cavity 44 equals its depth, and the bottom of the cavity 44 is closed by a bearing plate 46 held in place by machine screws 48.

The deforming beam 30 is moved between initial and final positions by an actuating mechanism 50 (FIG. 4), and that movement is such that in going from the initial position to the final position the forward end of the beam 30 moves downwardly past the free edge 14 of the anvil 12 and then beneath the anvil 12. The actuating mechanism 50 rotates in aligned bearings 51 (FIG. 1) located in the sidewalls 4 and includes end disks 52 which are received in and rotate in the bearings 51. Each disk 52 on its inside face is provided with a cam 54 which projects inwardly beyond the corresponding sidewall 4. The cams 54 of the two disks 52 are identical in configuration and position, and both are connected by an eccentric shaft 56 which extends through the journal cavity 44 in the bearing block 42 for the beam 30. The fit between the shaft 56 and journal cavity 44 is such that the former will rotate freely within the latter without significant free motion in the radial direction. The shaft 56 is fixed firmly to the two cams 54 at its ends so that the cams 54 will rotate in unison and maintain the same positioning relative to each other. Moreover, the shaft 56 is eccentric to the axis of rotation for the disks 52, the eccentricity being about five-eighth inches.

When the shaft 56 is slightly beyond top center (FIG. 4) the convex surface 32 at the forward end of the beam 30 is located generally above the free edge 14 of the anvil 12. From this position, which is the initial or starting position, the shaft 56 will move rearwardly and downwardly if the end disks 52 are rotated in the proper direction. When the shaft 56 reaches its rearmost position (FIG. 7), the beam 30 will be substantially horizontal with its bottom surface at about the same elevation as the upper surface of the anvil 12. Moreover, the convex surface 32 will now be located to the rear of the free edge 14. During the next 90° of rotation the convex surface 32 moves downwardly past the free edge (FIG. 8) and then forwardly underneath the anvil 12. The movement stops slightly beyond the bottom center for the shaft 56 (FIG. 9), and during this increment of movement the forward end of the beam 30 rises slightly, leaving the convex surface 32 located beneath the lower surface of the anvil 12 and the concave surface 34 located below the free edge 14. This is the final or terminal position for the beam 30. The entire movement occupies about 180° of rotation for the disks 52. The beam 30 is returned to its initial position when the disks 52 are rotated in the opposite direction. During the foregoing movements beam 30 pivots relative to the frame 2 about the spindles 20 and further slides rearwardly and then forwardly in the ways 22. Accordingly, the beam undergoes combined translation and rotation.

Located generally above the shaping beam 30 is a work clamping mechanism 60 (FIGS. 1 and 4–6) including a U-shaped bracket 62, the legs of which are located adjacent to the inside faces of the sidewalls 4 on the main frame 2 (FIG. 4). The U-shaped bracket 62 pivots about short pivot pins 64 which extend through the rear ends of its legs and also through the sidewalls 4 of the main frame 2 almost directly above the spindles 20 about which the beam 30 pivots. The cross portion of the U-shaped bracket 62 is located above the forward end of the beam 30 and bolted to this cross portion is a rigid clamping bar 66 which projects forwardly and then downwardly in front of the convex face 32 on the shaping beam 30. The bar 66 has recesses 68 (FIG. 6) at its sides which align with the side recesses 36 in the beam 30, and further has parallel slots 70 which align with the slots 38 in the beam 30. These slots 38 extend downwardly to the bottom edge of the clamping bar 66, creating hold down fingers 72 thereon. The lower ends of the hold down fingers 72 are coplanar, and the plane so defined is parallel to the upper surface of the anvil 12. The fingers 72 have notches at their lower ends adjacent the slots 70 to accommodate lock seams on the duct D.

Figure 7:
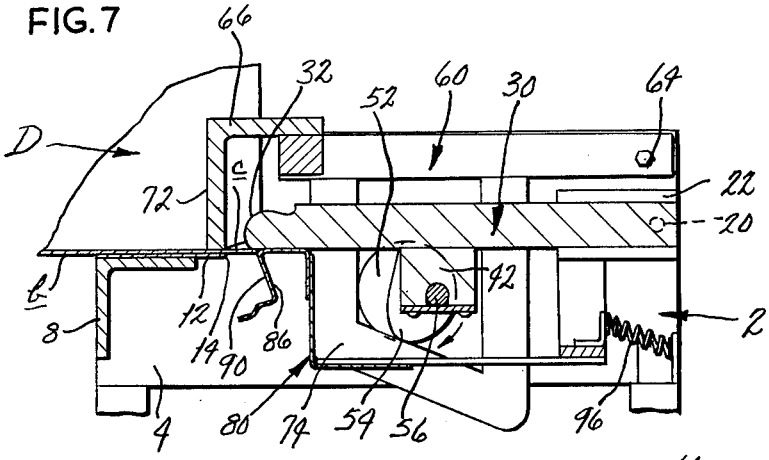
FIG. 7 is a sectional view similar to FIG. 4, but showing the beam as it is about to engage the lip on the duct section.
Figure 8:
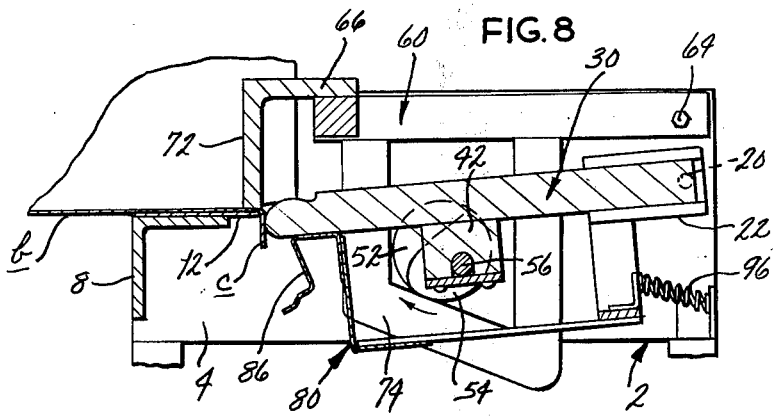
FIG. 8 is a sectional view similar to FIG. 4, but showing the beam as it moves downwardly past the anvil and bends the lip.
Figure 9:
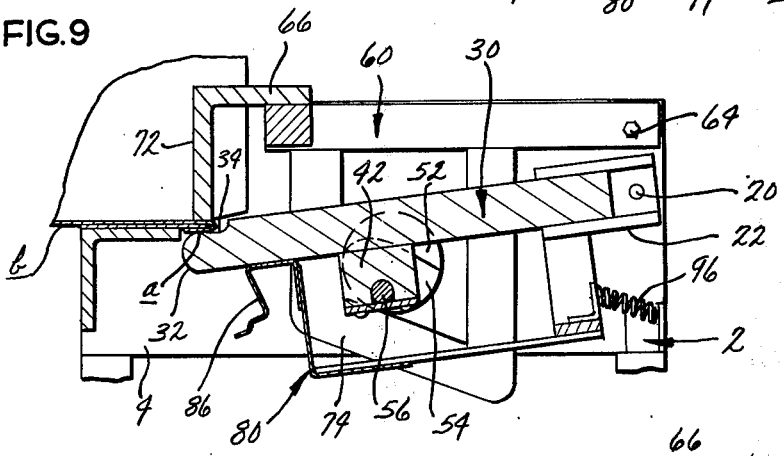
FIG. 9 is a sectional view similar to FIG. 4, but showing the beam in its final position.

The clamping mechanism 60 further includes cam followers 74 (FIGS. 4 and 5) which extend downwardly from the bracket 62 through the space between the side faces of the beam 30 and the two sidewalls 4 of the main frame 2. Each cam follower 74 has an inclined surface 76 (FIG. 4) which is located directly below the cam 54 projecting from the adjacent sidewall 4. In this regard, the cams 54 are for a major portion of their peripheries arcuate and concentric about the axis of rotation for the actuating mechanism 50. However, a portion of each cam 54 is cut away to provide a chordal segment which merges into the concentric segment at a curved intermediates segment of lesser radius. When the eccentric shaft 56 and beam 30 are at their initial or upper positions, the chordal segments of the cams 54 are presented downwardly toward the inclined surfaces 74 of their respective cam followers 74, but are nevertheless spaced from those surfaces. When so disposed the cross piece on the U-shaped bracket 62 rests on the beam 30 and the clamping mechanism 60 is held in an elevated position with its fingers 72 spaced from the anvil 12. As the eccentric shaft 56 approaches its rearmost position (FIG. 7), the intermediate segments of the cams 54 engage the inclined surfaces 76 of their respective followers 74, and thereafter the arcuate segments move against the inclined surfaces 76 on the followers. When the arcuate segments operate against the followers 74, the clamping bar 66 may not be raised and indeed its hold down fingers 72 will press firmly against the anvil 12. The condition exists for the remainder of the movement of the eccentric shaft 56 to its final position (FIGS. 8 and 9). When the eccentric shaft 56 rotates in the opposite direction back to its initial position, the cams 54 will release the followers 74 before the beam 30 rises against the U-shaped bracket 62, so that when the beam 30 does come against the bracket 62, it will elevate the bracket 62 and raise the fingers 72 away from the anvil 12.

While the work clamping mechanism 60 is located generally above the shaping beam 30, a gauging mechanism 80 (FIGS. 4–6) is located generally below the beam 30. The gauging mechanism 80 includes a pivot bracket 82, the sides which extend upwardly between the sidewalls 4 of the main frame 2 and the opposing side faces of the ways 22, and the spindles 20 project through these sides and provide a journal about which the bracket 82 pivots. The bracket 82 extends under the rear portion of the beam 30. Fastened to the pivot bracket 82 is another U-shaped bracket 84 which extends forwardly beneath the bearing block 42 on the beam 30 and then turns upwardly to the rear of the anvil 12. The upper edge of the frame 84 bears against the flat underside of the beam 30 generally midway between the bearing block 42 and the convex leading surface 32 therein. The upper portion of the U-shaped frame 84 has gauging fingers 86 (FIGS. 4 and 6) on it and these fingers are spaced apart in the transverse direction such that the spaces between them align with the slots 38 in the beam 30, but are of slightly greater width. Each gauging finger 86 includes an upper segment 88 which is parallel to and bears against the underside of the beam 30 and a positioning or abutment segment 90 which projects upwardly from the forward end of the upper segment 88 (FIG. 4). Indeed, the positioning segment 90 is inclined rearwardly so that its lower margin is disposed further rearwardly than its upper margin, and this inclination exists even when the beam 30 and the gauging mechanism 80 are in their intial or uppermost positions. Actually, the upper end of the positioning segment 90 is located further from the axis of the spindles 20 than the lower end, and this accounts for the inclination. Moreover, when the upper end is located directly opposite the end edge 14 of the anvil 12, the spacing between the gauging portion 90 and the edge 14 equals the desired width of the cleat edge *a* (FIG. 7). However, when the lower end is located opposite the edge 14 of the anvil 12, the spacing between the edge 14 and the gauging portion 90 is greater than the width of the cleat edge *a* (FIG. 4). The lower end of the positioning segment 90 merges into a lift off segment 92 which projects forwardly and downwardly. When the beam 30 and the gauging mechanism 80 are in their initial positions, the forward ends of the lift off segments 92 will be located directly below the free edge 14 on th anvil 12, while the rear end of the lift off segments 92 will be at an elevation slightly higher than that of the upper surface on the anvil 2. Indeed, near the positioning segment 90, the lift off segment 92 is provided with a slight rib or crease 94 to provide greater elevation in that vicinity.

The gauging mechanism 80 further includes a spring 96 which bears against the bracket 84 and urges it upwardly. The spring 96 has the effect of maintaining the upper segments 88 of the gauging fingers 86 continuously against the underside of the shaping beam 30 irrespective of the position the beam 30 assumes. Hence, the gauging segments 90 are always positioned to the rear of the convex leading surface 32 on the beam 30.

On of the disks 52 of the actuating mechanism 50 is connected to a suitable drive mechanism which may be a reversible electric motor, an air cylinder, or merely a simple handle 98 (FIG. 1).

OPERATION

When the machine A is in its initial or work receiving condition, the actuating assembly 50 is rotated to its fullest extent in the direction which elevates the beam 30 (FIG. 4). In that position, the lower surface of the beam 30 is located a substantial distance above the upper surface of the anvil 12, at least at the forward end of the beam 30. The beam 30 in turn holds the clamping mechanism 60 upwardly so that its hold down fingers 72 are likewise located a substantial distance above the anvil 12. The convex leading surface 32 on the beam 30 will bear against the back faces of the hold down fingers 72 and prevent the beam 30 from moving further forwardly and this in turn stops the eccentric shaft 56 just prior to its top center position. The gauging finers 86 of the gauging mechanism 80 are urged upwardly by the spring 96, thus locating the positioning segments 90 of these fingers to the rear of the free edge 14 on the anvil 12.

With the machine A in the foregoing initial position, a duct section D having lips *c* on the four walls thereof is laid on the work surface S and advanced over the anvil 12 toward the beam 30 (FIG. 1). In so doing, the duct section D is adjusted laterally such that the lips *c* on its side or vertical walls will align with two of the slots 70 in the clamping bar 66 or else with a slot 70 and one of the side recesses 68. In this connection, it should be noted that ducts are normally made in widths of even number (E.g. 10 inches, 12 inches, 14 inches, etc.) and since the slots 70 are located on 2 inch centers, two of the slots 70 should align with the lips *c* on the vertical sidewalls. However, some ducts sections D are made in widths of odd numbers (or one-half inch variations), and in that case one of the vertical lips *c* advanced into the end recess 68 or one of the slots 70 on the left hand side of the bar 66 which is where the slots 70 are on 1½ inch centers.

In any event, when the vertical lips *c* align with two slots 70 or with a slot 70 and a side recess 68, the duct D may be advanced toward the beam 30 until the lip *c* on the lower wall *b* abuts against the positioning segments 90 of the gauging fingers 86 (FIG. 4). Inthat case, the lower lip *c* projects beyond the free edge 14 on the anvil 12.

Once the duct section D is properly positioned against the gauging fingers 86, the drive mechanism is energized to rotate the actuating mechanism 50 toward its final position. As the eccentric shaft 56 moves away from top center it moves the beam 30 both rearwardly and downwardly. The rearward motion is accommodated at the ways 22, while the downward motion is accommodated through the pivoting of the ways 22 at the spindles 20. The clamping bar 66 descends with the beam 30 since it is merely supported on the beam 30 at this point in the operating cycle. The gauging fingers 86 likewise descend since they are merely held against the underside of the beam 30 by the spring 96, and as they descend, the positioning segments 90 thereon move over the edge 14 of the lip *c*. Since the positioning segments 90 are inclined such that their upper edges are located further forwardly than their lower edges, the entire duct D is forced slightly backwardly away from the beam 30. Indeed, the gauging portion 90 positions the duct D such that the amount of lip *c* which projects over the edge 14 on the anvil 12 equals the desired width of the cleat edge *a*.

Just as the lower surface of the beam 30 comes against the upper surfce of the lip *c* (FIG. 7), the concentric portions of the two cams 54 will move againts the surfaces 76 of their respective followers 74 and thereby force the hold-down fingers 72 against the lower wall *b* on the duct section D. This clamps the lower wall *b* against the anvil 12 and thereby holds the duction section D firmly in place on the work supporting surface S (FIG. 1). At this point in the cycle the eccentric shaft 56 is in its rearmost position, which is midway between top and bottom center.

Continued rotation of the actuating mechanism 50 brings the lower surface of the beam 30 downwardly against the lip *c* and deflects the lip *c* downwardly over the edge 14 of the anvil 12. As the shaft 56 moves downwardly from its rearmost position (FIG. 8) it further moves forwardly, and consequently the forward end of the beam 30 likewise moves downwardly and forwardly. The downward movement is substantially greater than the forward movement as the lower surface of the beam 30 passes by the free edge 14 of the anvil 12, and this is when the downward bending occurs, The convex leading surface 32 on the beam 30 wipes over the downwardly bent portion of the lip *c*.

As the eccentric shaft 56 approaches its bottom center position its forward movement exceeds its downward movement by a substantial amount and at this time the forward end of the beam 30 moves under the anvil 12. In so doing, the convex leading surface 32 pushes against the downwardly turned lip *c* and drives the lip *c* rearwardly underneath the anvil 12, wiping against that lip *c* as it does.

During the final increment of movement, the eccentric shaft 56 moves slightly beyond bottom center so that the upwardly presented portion of the convex leading surface 32 forces the extreme end of the rearwardly turned lip *c* upwardly against the underside of the anvil 12 (FIG. 9). When the beam 30 is so disposed the concave surface 34 will be located below the edge 14 so that the portion of the lip *c* at the edge 14 is not flattened against the underside of the anvil 12 to such an extent. Now when the actuating mechanism is reversed to move the beam 30 back to its final position, the extreme end of the lip *c* will spring back slightly so that the cleat edge *a* so formed assumes a generally horizontal disposition beneath the anvil 12.

Once the eccentric shaft 56 clears its rearmost position on the return, the underside of the beam 30 rises above the upper surface of the anvil 12 and the cams 54 free the followers 74, permitting the beam 30 to lift the clamping bar 66 away from the anvil 12. This frees the duct section D so that it may be removed upon return of the actuating mechanism 50 and beam 30 to their intial positions.

Figure 10:
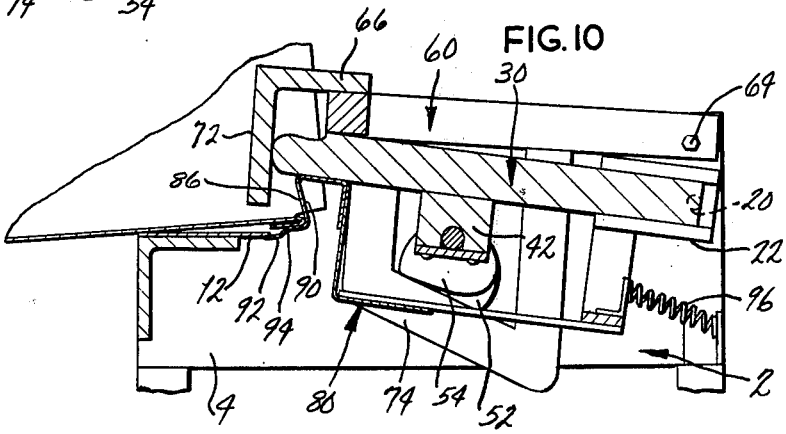
FIG. 10 is a sectional view similar to FIG. 4, but showing the gauging mechanism lifting the cleat edge free of the anvil.

The gauging assembly 80 facilitates removal of the duct section D inasmuch as its fingers 86 are provided with the lift off segments 92 which are inclined upwardly away from the underside of the anvil 12. Hence, to free the cleat edge *a* from its engagement with the anvil 12, the duct section D is merely pushed toward the beam 30 (FIG. 10). This causes the cleat edge *a* to ride upwardly on the lift off segment 72 and when the cleat edge *a* moves upon the crease 94 it is high enough to clear the edge 14 of the anvil 12. In this regard, it will be recalled that when the gauging mechanism 80 is in its upper position, the space between the positioning portions 90 of the gauging fingers 86 exceeds the width of the cleat edge *a*. Thus, the operator need not lift the duct section D upwardly to clear the edge 14, since the gauging mechanism 80 assumes this function.

The lip *c* on the opposite wall *b* is converted into a cleat edge *a* in a similar manner.

The machine A may be constructed to accommodate extremely wide ducts, and for wider configurations the deforming beam 30 may be reinforced with a stiffening bar extended over the top of it immediately behind the clamping bar 66 of the clamping mechanism 60. The clamping bar 66 may be reinforced in a similar manner.

This invention is intended to cover all changes and modifications of the example of the invention herein chosen for purposes of the disclosure which do not constitute departures from the spirit and scope of the invention.

What is claimed is:

1. A machine for forming a reversely bent cleat edge on sheet metal, said machine comprising: a frame, an anvil supported on the frame, the anvil having free edge and being relatively thin in cross-section adjacent to the edge, the anvil providing a first surface against which the sheet metal is positioned with a portion projected over the free edge and also a second surface which is located on the opposite side thereof; a deforming beam supported on the frame and having a forward end located adjacent to the free edge of the anvil and a rear end located remote from the anvil, the beam being movable from an initial position to a final position, the beam when in the initial position having its forward end spaced from the free edge and first surface of the anvil so that the sheet metal when projected over the free edge will be generally between the free edge and the forward end of the beam, the beam when in its final position having its forward end located generally opposite the second surface of the anvil; and actuating means for moving the beam from its initial to its final position with the forward end being continually presented toward the anvil and the rear end being always located further from the anvil than the forward end, the actuating means moving the beam such that the beam movement is characterized by combined translation and rotation and such that the forward end of the beam passes by the free edge and then along the second surface of the anvil, whereby the portion of the sheet metal projected beyond the free edge of the anvil will be bent over the free edge and then reversely behind the anvil along the second surface thereof to form the cleat edge on the sheet metal.

2. A machine according to claim 1 wherein the anvil is flat and of substantially uniform thickness adjacent to the free edge.

3. A machine according to claim 1 and further comprising clamping means for clamping the sheet metal against the first surface of the anvil as the forward end of the beam moves past the free edge and bends the sheet metal.

4. A machine according to claim 3 wherein the clamping means pivots relative to the frame and includes a bar which presses the sheet metal against first surface of the anvil; and wherein the actuating means holds the clamping means such that the bar forces the sheet metal against the anvil.

5. A machine according to claim 4 wherein the beam when in its initial position supports the clamping means with its clamping bar spaced from the anvil.

6. A machine according to claim 5 wherein the actuating means includes a cam which engages the clamping means to hold the clamping bar thereof against the sheet metal, but is disengaged from the clamping means when the beam is in its initial position so that the clamping bar may be positioned away from the anvil.

7. A machine according to claim 1 and further comprising gauging means for positioning the sheet metal on the anvil such that the portion projected beyond the free edge is of predetermined width.

8. A machine according to claim 7 wherein the gauging means is spring biased against the beam and includes a positioning surface located directly beyond the free edge of the anvil when the beam is in its initial position.

9. A machine according to claim 1 and further comprising means at the rear end of the beam to permit the beam to slide relative to the frame and to also pivot relative to the frame about an axis fixed with respect to the frame.

10. A machine according to claim 1 and further comprising means enabling the beam to slide and pivot relative to the frame as it moves from the initial position to its final position.

11. A machine according to claim 10 wherein the actuating means rotates on the frame about an axis which is fixed in position with respect to the frame, and includes an eccentric shaft which is offset from and parallel to the axis of rotation for the actuating means, the shaft being connected with the beam between the forward end of the beam and the location at which the beam pivots relative to the frame.

12. A machine according to claim 10 wherein the beam at its forward end has a convex surface and a concave surface with the convex surface being presented forwardly and also generally away from the first surface when the beam is in its initial position and the concave surface being merged into and located rearwardly from the convex surface, the concave surface being located opposite the free edge of the anvil when the beam is in its final position.

13. A machine according to claim 1 wherein the beam is elongated and has slots which open out of its forward end and are perpendicular to the surface of the anvil so that the beam will not interfere with the side walls of rectangular ducts when used to bend cleat edges on other walls of such ducts.

14. A machine for forming a reversely bent cleat edge on sheet metal, said machine comprising: a frame, a flat plate-like anvil on the frame and having a free edge, the upper surface of the anvil providing a working support surface for supporting the sheet metal with a portion of the metal projected over the free edge, the lower surface of the anvil being unobstructed adjacent to the free edge; a beam having its forward end located adjacent to the free edge of the anvil; means at the rear end of the beam for confining the beam on the frame for both longitudinal and pivotal movement relative to the frame; and an actuating mechanism including side elements rotatable relative to the frame about an axis of rotation which is fixed in position with respect to the frame and an eccentric shaft connecting the elements and being offset from yet parallel to the axis of rotation for the elements, the eccentric shaft being connected with the beam such that when the beam is in an initial position with its forward end generally above the free edge and the elements are rotated, the forward end of the beam will move downwardly to engage the portion of the sheet metal projected oer the edge so as to bend that portion downwardly over the edge and thereafter the forward end of the beam will move under the anvil to bend the downwardly projected portion underneath the anvil so as to form a reversely bent cleat edge on the sheet metal.

15. A machine according to claim 14 and further comprising a clamping mechanism pivoted on the frame and having a clamping bar located over the anvil; and wherein cams are mounted on the rotatable side elements and hold the clamping mechanism downwardly as the forward end of the beam moves past the free edge of the anvil so as to cause the clamping bar to clamp the sheet metal between it and the anvil.

16. A machine according to claim 14 and further comprising a gauging mechanism pivoted on the frame and located beneath the beam, the gauging mechanism being urged upwardly against the bottom of the beam and including a positioning surface located beyond the free edge of the anvil when the beam is in its initial position, whereby the amount of sheet metal projected beyond the free edge of the anvil is determined by the positioning surface.

17. A machine according to claim 16 wherein the gauging mechanism further includes a lift of surface which when the beam is in its initial position is inclined upwardly from immediately beneath the free edge, whereby the cleat edge is disengaged from the anvil merely by pushing the sheet metal toward the beam so as to cause the cleat edge to ride upwardly on the lift off surface to a position where it will not engage the anvil when pulled away from the beam.

18. A machine for forming a reversely bent cleat edge on sheet metal, said machine comprising: a frame; an anvil supported on the frame, the anvil having a free edge and being relatively thin in cross-section adjacent to the edge, the anvil providing a first surface against which the sheet metal is positioned within a portion projected over the free edge and also a second surface which is located on the opposite side thereof; a deforming beam supported on the frame and having a forward end located adjacent to the free edge of the anvil, the beam being movable from an initial position to a final position, the beam when in the initial position having its forward end spaced from the free edge and first surface of the anvil so that the sheet metal when projected over the free edge will be generally between the free edge and the forward end of the beam, the beam when in its final position having its forward end located generally opposite the second surface of the anvil; means at the rear end of the beam to permit the beam to slide relative to the frame and to also pivot relative to the frame about an axis fixed with respect to the frame, said means comprising ways which receive the rear end of the beam and permit it to slide therein, the ways being pivoted on the frame for rotational movement about an axis which is fixed with respect to the frame; and actuating means for moving the beam from its initial to its final position such that its forward end passes by the free edge and then along the second surface of the anvil, whereby the portion of sheet metal projected beyond the free edge will be bent over the free edge and then reversely behind the anvil along the second surface threof to form the cleat edge on the sheet metal.

19. A machine for forming a reversely bent cleat edge on sheet metal, said machine comprising: a frame; an anvil supported on the frame, the anvil having free edge and being relatively thin in cross-section adjacent to the edge, the anvil providing a first surface against which the sheet metal is positioned with a portion projected over the free edge and also a second surface which is located on the opposite side thereof; a deforming beam supported on the frame and having a forward end located adjacent to the free edge of the anvil; the beam being movable from an initial position to a final position, the beam when in the initial position having its forward end spaced from the free edge and first surface of the anvil so that the sheet metal when projected over the free edge will be generally between the free edge and the forward end of the beam, the beam when in final position having its forward end located generally opposite the second surface of the anvil; actuating means for moving the beam from its initial to its final position such that its forward end passes by the free edge and then along the second surface of the anvil, whereby the portion of sheet metal projected beyond the free edge will be bent over the free edge and then reversely behind the anvil along the second surface thereof to form the cleat edge on the sheet metal; and gauging means for positioning the sheet metal on the anvil such that the portion projected beyond the free edge is of predetermined width, the gauging means being spring biased against the beam and including a positioning surface located directly beyond the free edge of the anvil when the beam is in its initial position, and a lift off surface which extends at an angle from the positioning surface to the second surface on the anvil when the beam is in its initial position so that after the cleat edge is formed and the beam is returned to its initial position, the sheet metal may be disengaged from the anvil and moved away from the anvil merely by pushing it toward the beam and allowing the cleat edge to ride away from the free edge on the lift off surface.

20. A machine for forming a reversely bent cleat edge on sheet metal which may contain a bend so as to have at least two walls oriented at right angles to each other, said machine comprising: a frame; an anvil supported on the frame, the anvil having a free edge and being relatively thin in cross section adjacent to the edge, the anvil providing a first surface against which one wall of the sheet metal is positioned with a portion of that wall projected over the free edge and also a second surface which is located on the opposite side of the anvil from the first surface; a deforming beam supported on the frame and having a forward end located adjacent to the free edge of the anvil, the deforming beam extending away from the anvil, the deforming beam having slots which open out of the forward end thereof and are oriented perpendicular to the first surface of the anvil to accommodate the other wall of the sheet metal when said one wall is against the first surface; and means for moving the deforming beam such that the forward end thereof passes from an initial position in which the forward end is spaced from the first surface and free edge of the anvil, past the free edge of the anvil where the forward end will bear against the projected portion of said one wall on the sheet metal and bend the projected portion over the free edge, and then to a final position in which the forward end is located opposite to the second surface so that the projected portion of said one wall is bent rearwardly along the second surface, the means for moving the deforming beam causing the deforming beam to shift forwardly as the forward end of the beam moves to it final position with the movement being characterized by at least a component of translation.

21. A machine according to claim 20 wherein the movement of the deforming beam is further characterized by a component of rotation.

22. A machine according to claim 20 and further comprising gauging means movable with the beam and including a positioning surface located opposite the free edge when the forward end of the beam is in its initial position, the positioning surface being located at an angle with respect to the first surface, the angle being such that as the forward end for the beam moves away from its initial position and moves the gauging means with it, the spacing between the free edge of the anvil and the positioning surface lessens so that the sheet metal is forced rearwardly, whereby after the cleat edge is formed and the forward end of the beam is returned to its initial position, sufficient clearance will exist between the free edge of the anvil and the positioning surface to enable the cleat edge to be easily disengaged from the anvil.

23. A machine according to claim 20 wherein the forward end of the beam is curved, and the beam initially contacts the projected portion near one end of the curved surface, and when the beam is in its final position, the forward end bears against the bent cleat edge near the opposite end of the curved surface.

24. A machine according to claim 20 wherein the deforming beam extends away from the anvil generally in the direction of the first surface.

* * * * *

UNITED STATES PATENT OFFICE
CERTIFICATE OF CORRECTION

Patent No. 4,014,200 Dated March 29, 1977

Inventor(s) Oswald H. Wolters

It is certified that error appears in the above-identified patent and that said Letters Patent are hereby corrected as shown below:

Column 7, line 8, "finers" should be "fingers".

Column 7, line 10, "these" should be "those".

Column 7, line 67, "duction" should be "duct".

Column 8, line 34, "final" should be "initial".

Column 10, lines 41 and 42 (Claim 14) "working" should be "work".

Column 10, line 59 (Claim 14) "oer" should be "over".

Column 11, line 15 (Claim 17) "of" should be "off".

UNITED STATES PATENT OFFICE

CERTIFICATE OF CORRECTION

Patent No. 4,014,200 Dated March 29, 1977

Inventor(s) Oswald H. Wolters

It is certified that error appears in the above-identified patent and that said Letters Patent are hereby corrected as shown below:

Column 11, line 28, "within" should read -- with --.

Column 12, line 3, after "in" insert -- its --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*